US007208063B2

(12) United States Patent
Karmarkar et al.

(10) Patent No.: US 7,208,063 B2
(45) Date of Patent: Apr. 24, 2007

(54) DOUBLE WALLED STRUCTURAL REINFORCEMENT

(75) Inventors: Uday Prakash Karmarkar, Akron, OH (US); Hisham Tawfig Mohamed, Fairlawn, OH (US)

(73) Assignee: Akron Rubber Development Laboratory, Inc., Akron, OH (US)

( * ) Notice: Subject to any disclaimer, the term of this patent is extended or adjusted under 35 U.S.C. 154(b) by 418 days.

(21) Appl. No.: 10/640,163

(22) Filed: Aug. 13, 2003

(65) Prior Publication Data

US 2004/0031235 A1 Feb. 19, 2004

Related U.S. Application Data

(60) Provisional application No. 60/403,144, filed on Aug. 14, 2002.

(51) Int. Cl.
*B31F 1/20* (2006.01)

(52) U.S. Cl. ..... 156/205; 156/209; 156/210; 264/286

(58) Field of Classification Search ..... 156/205; 264/286; 428/116, 118; 52/783.11, 783.14, 52/783.16, 783.17, 793.1; 229/87.02, 90
See application file for complete search history.

(56) References Cited

U.S. PATENT DOCUMENTS 2,978,006 A * 4/1961 Clemens ..... 156/210
3,272,329 A * 9/1966 Mehalov ..... 206/443
3,513,529 A 5/1970 Hitchens
3,669,820 A 6/1972 Fredericks
4,906,508 A 3/1990 Blankenburg et al.
5,116,689 A 5/1992 Castro et al.
5,881,459 A * 3/1999 Yasui ..... 29/897.32

OTHER PUBLICATIONS

Composite Materials Group, http://www.mtm.kuleuven.ac.be/Research/C2/poly/Honeycombs.htm, 3 pages.
Skin to Honeycomb Core Delamination Detection With Guided Waves, Joseph L. Rose and Thomas Hay, http://www.ndt.net/article/wcndt00/papers/idn271/idn271.htm, 7 pages.
Estimating Impact Damage in Honeycomb Sandwich Panels, http://www.lusas.com/case/composite/honeycomb.html, 4 pages.

* cited by examiner

*Primary Examiner*—Jessica Rossi
(74) *Attorney, Agent, or Firm*—Hahn Loeser & Parks, LLP; Robert J. Clark

(57) ABSTRACT

A double walled reinforcement structure and method for making a double walled reinforcement structure having a plurality of longitudinally extending and nested structural members. Each structural member comprises a first cell having a first cross-section and a second cell having a second cross-section. The second cell is positioned within the first cell and the second cell contacts the first cell in a plurality of locations to provide mutual support of the cells in a manner increasing the tensile and compressive strength of the structure.

21 Claims, 5 Drawing Sheets

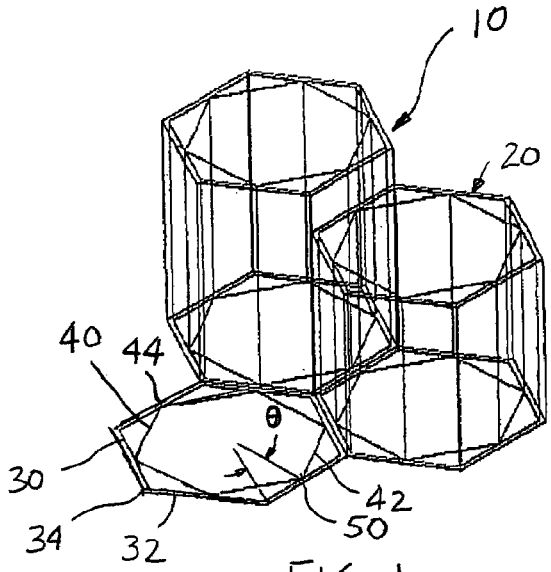
FIG. 1
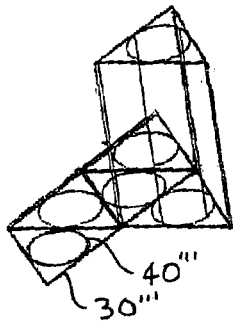
FIG. 4
FIG. 3
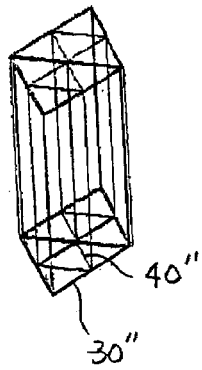
FIG. 2
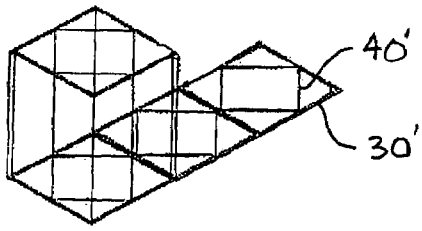

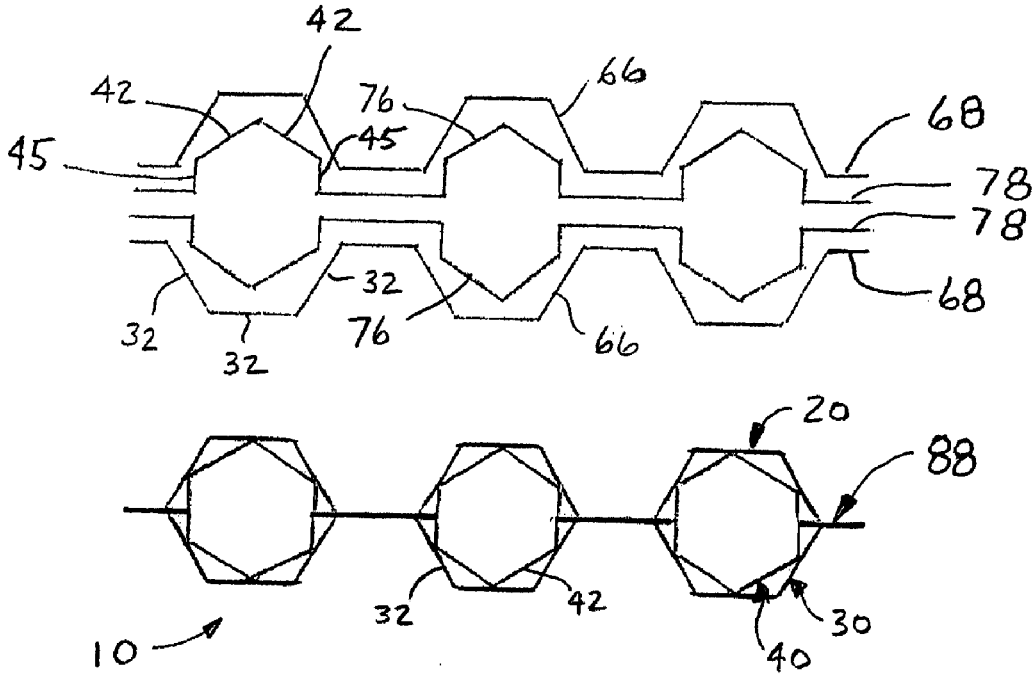
FIG. 15
FIG. 16
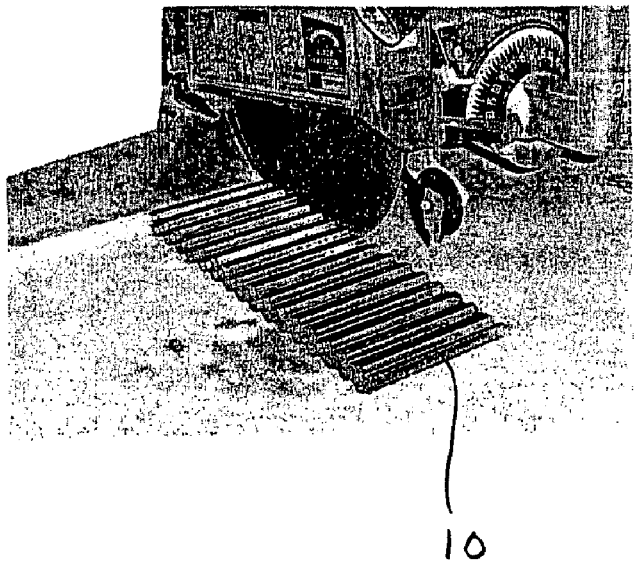

DOUBLE WALLED STRUCTURAL REINFORCEMENT

TECHNICAL FILED

This application claims the benefit of U.S. patent application Ser. No. 60/403,144, filed Aug. 14, 2002 and is hereby incorporated by reference. This invention relates to a double walled structural reinforcement, and more particularly to a structure having an inner cell which engages the outer cell at a plurality of locations in a manner increasing the strength and rigidity of the structure.

BACKGROUND OF THE INVENTION

Multi-celled structures are used in a wide variety of applications where light weight and relatively high strength structures are needed to support and/or protect a particular item. One particularly effective structure is the honeycomb which comprises a plurality of nested hexagonal structures. Bees use wax honeycomb to build hives to keep their larvae safe. Aircraft manufacturers use aluminum honeycomb as a core material for aircraft control surfaces. Packagers use kraft paper honeycomb to support and protect products during transportation. The cellular form of honeycomb provides outstanding top-to-bottom compression strength. Besides a high strength to weight ratio, other advantages include resistance to shock, high insulation value, cushioning, and low thermal conductivity factors.

While aluminum honeycomb has been mentioned as used in aerospace applications, another core material has gained considerable popularity in aerospace and commercial applications. NOMEX® honeycomb is a lightweight, high strength, non-metallic honeycomb manufactured with aramid fiber paper. The aramid fiber paper is coated with a heat resistant phenolic resin. NOMEX® honeycomb has a higher shear strength and much higher compressive strength than aluminum honeycomb and is used in aircraft interiors, exteriors and other structural components.

However, several problems with NOMEX® and other honeycomb core materials have been their susceptibility to water, delamination, and impact resistance. Another problem is that strength of the structure is limited by the structure material, for example, a manufacturer may want to use an aluminum honeycomb core but may need additional shear and/or compression strength without adding significant weight to the structure. While honeycomb and other multi-celled structures provide a substantial benefit to various industries, it would be advantageous to provide a multi-celled structure providing additional improvement over current known structures which overcomes one or more of these problems.

SUMMARY OF THE INVENTION

It is therefore an object of the present invention to provide a new structure that is even stronger than known structures. This and other advantages are provided by a structure comprising: a plurality of longitudinally extending structural members, each structural member comprising a first cell having a first cross-section selected from the group consisting of a polygon, an ellipse, and a circle, and a second cell having a second cross-section selected from the group consisting of a polygon, an ellipse, and a circle; wherein the second cell is positioned within the first cell and the second cell contacts the first cell in a plurality of locations to provide mutual support of the cells.

These and other advantages are also provided by a method of manufacturing a structure comprising the steps of: forming an inner cell having a first cross-section selected from the group consisting of a polygon, an ellipse, and a circle; forming an outer cell around the inner cell wherein the outer cell has a second cross-section selected from the group consisting of a polygon, an ellipse, and a circle, such that the inner cell contacts the outer cell in a plurality of locations to provide mutual support of the cells.

BRIEF DESCRIPTION OF THE DRAWINGS

This invention will now be described in further detail with reference to the accompanying drawings, in which:

FIG. 1 is a perspective view of a first embodiment of the present invention showing the double honeycomb cell configuration;

FIG. 2 is a perspective view of a second embodiment of the present invention showing the double rectangle cell configuration;

FIG. 3 is a perspective view of a third embodiment of the present invention showing the double triangle cell configuration;

FIG. 4 is a perspective view of a third embodiment of the present invention showing a triangle and circle cell configuration;

FIG. 15 is an exploded end view and an assembled end view of a double walled hexagonal structure in accordance with an embodiment of the present invention;

FIG. 16 is a perspective view of the machining of the double walled hexagonal structure to its final form.

DETAILED DESCRIPTION OF THE INVENTION

Figure 5:
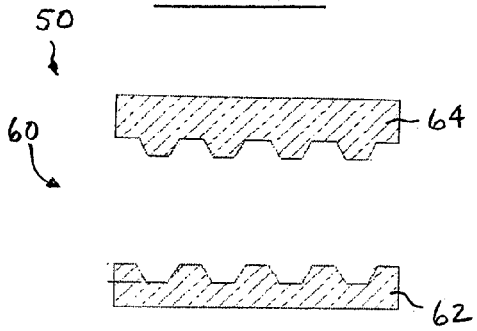
FIG. 5 is a cross-sectional view an outer cell mold for use in making a formed corrugated sheet in accordance with an embodiment of the method of the present invention.
Figure 6:
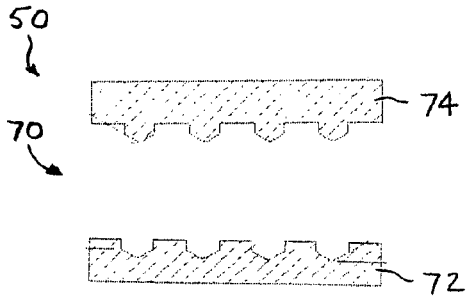
FIG. 6 is a cross-sectional view an inner cell mold for use in making a formed corrugated sheet in accordance with an embodiment of the method of the present invention.
Figure 7:
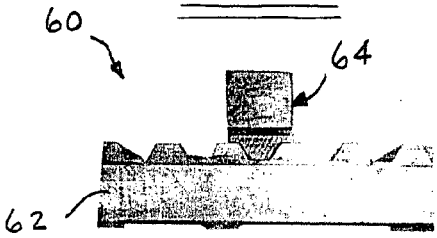
FIG. 7 is an end view of an outer cell mold having a mold base plate and one top mold plate of an inner cell mold for use in making a formed corrugated sheet in accordance with an embodiment of the method of the present invention.
Figure 8:
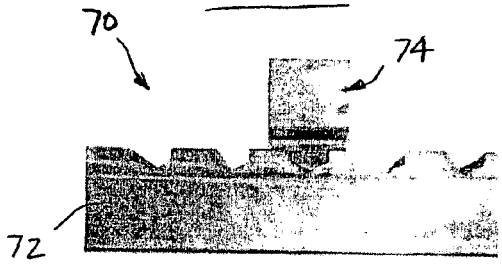
FIG. 8 is an end view of an inner cell mold having a mold base plate and one top mold plate of an inner cell mold for use in making a formed corrugated sheet in accordance with an embodiment of the method of the present invention.
Figure 9:
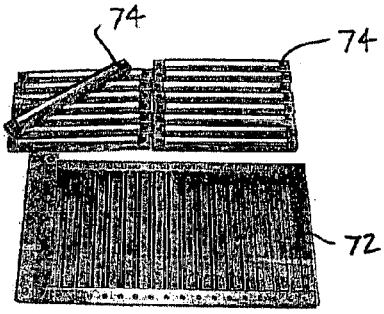
FIG. 9 is a perspective view an inner cell mold showing the mold base plate and a plurality of top mold plates.

This invention will now be described in detail with reference to various embodiments thereof. Referring now to FIG. 1, a first embodiment of the structure 10 of the present invention is shown comprising a plurality of longitudinally extending structural members 20, each structural member comprising a first cell 30 having a polygonal cross-section in the form of a hexagon, and a second cell 40 having a second polygonal cross-section. Each cell 30, 40 has a plurality of linear walls 32, 42, and a plurality of corners 34, 44. The second cell 40 is positioned within the first cell 30 and the second cell 40 contacts the first cell 30 in a plurality of locations 50 to provide mutual support of the cells 30, 40. More particularly, the second cell is rotated with respect to the first cell at an angle Θ such that the corners 44 of the second cell 40 contact the walls 32 of the first cell 30. The angle Θ is preferably one hundred eighty degrees divided by the number of sides of the polygon. However it is also contemplated that other angles of rotation may be used which provide a non symmetric distance between the contact point of the second cell 40 on the linear wall 32 of the first cell 30 and the corners 34 adjacent the linear wall 32.

While the corners 44 may merely be in contact with the linear walls 32 to be effective, it is also contemplated that the corners 44 may be attached or bonded to the linear walls 32 to provide additional strength. It is also possible to extrude or mold the cells 30, 40 such that the walls 32, 42 of the plurality of structural members 20 are integrally interconnected.

Although the cells 30, 40 are shown as hexagons, the invention is not intended to be limited as such and the cells may be any appropriate shape including other polygons (triangles 30', 40', rectangles 30", 40", pentagons 30''', 40''', etc.) or may be a circle or an ellipse. FIG. 2 shows a double rectangle or square cell configuration; FIG. 3 shows a double triangle cell configuration; while FIG. 4 shows a possible combination of dissimilar shapes such as a first cell in the form of a triangle and a second cell in the form of a circle.

The plurality of structural members 20 are nested together, which in the case of the hexagonal first cells 30 provides a honeycomb structure. As the members are nested, each discrete cell 30 has at least one linear wall 32 registering against a linear wall of an adjacent cell. Additionally, the corners 42 of the second cell 40 are positioned adjacent corners 42 of an adjacent second cell 40. In this manner the structure 10 reinforces itself wherein the second cell 40 is reinforced by the first cell 10 and vise versa, as well as by adjacent first 30 and second cells 40. In another embodiment it is also contemplated that at least one linear wall 32 is shared by adjacent cells 30 such that the plurality of structural members are all interdependent such as in a true honeycomb.

As previously mentioned, the double cell configuration of the present invention can be manufactured using a molding process, an example of which will now be discussed in greater detail. As shown in FIGS. 5–9, the double cell mold 50 comprises an outer cell mold 60 and an inner cell mold 70. In one embodiment, the molds are manufactured from steel such as typical low carbon free machining steel, however, any suitable material may be used and the invention is not intended to be limited to a particular mold material. The outer cell mold 60 comprises a bottom base 62 and a plurality of longitudinal top mold members 64 which may be secured to the bottom base 62. The outer cell mold 60 is configured to produce a sheet 68 comprising a plurality half hexagonal cells 66 having a three full linear walls 32. After being removed from the molds 60 and as discussed below with relation to FIG. 15, two sheets 68 of the pluralities of half hexagonal cells 66 may be placed on top of each other and secured by an adhesive to form a plurality of hexagonal first cells 30, each cell having six full linear walls 32. Each of the cells 30 are separated from each other by a linear wall 32 which provides a space for nesting additional cells 30. Similarly, the inner cell mold 70 comprises a bottom base 72 and a plurality of longitudinal top mold members 74 which may be secured to the bottom base 72. The inner cell mold 70 is configured to produce a sheet 78 comprising a plurality of half hexagonal cells 76 having two full linear walls 42 positioned between two linear wall segments 45. Two pluralities of half hexagonal cells 76, are placed on top of each other and secured by an adhesive to form a plurality of hexagonal second cells 40 having six full linear walls 42. It is noted that the inner cell mold 70 produces half hexagonal cells 76 that are rotated fifteen degrees from the half hexagonal cells 66 produced by the outer mold 60. It is also contemplated that the half hexagonal cells 76 may either be slightly smaller than the half hexagonal cells 66 produced by the outer mold 60 to allow for clearance, or the half hexagonal cells 76 may be the same size as the half hexagonal cells 66 produced by the outer mold 60 to allow for the adhesive thickness between the sheets 68, 78. Having equal sized inner and outer cells 76, 66 may also provide a preloaded interference fit between the cells which may enhance their physical properties. Accordingly, a plurality of structural members 20 may be produced by placing the two sheets 78 of half hexagonal cells 76 between the two sheets 68 of rotated half hexagonal cells 66.

Figure 10:
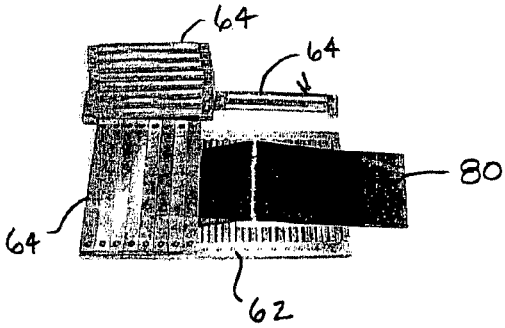
FIG. 10 is a perspective view of the prepreg sheet in a cell mold showing the mold base plate and a plurality of top mold plates.
Figure 11:
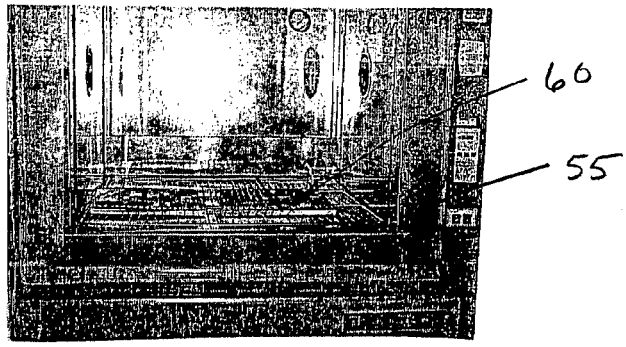
FIG. 11 is a perspective view of the molds placed in an oven.
Figure 12:
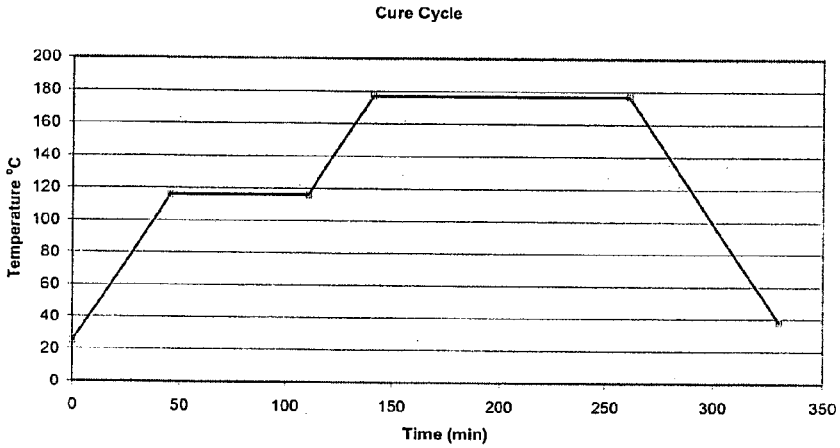
FIG. 12 is a graph of a curing cycle for a particular core material.
Figure 13:
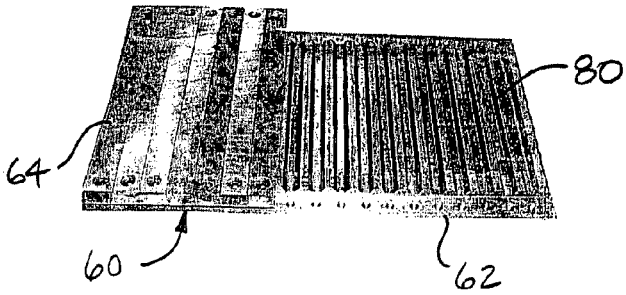
FIG. 13 is a perspective view of the formed material in the mold with some of the top mold plates removed.
Figure 14:
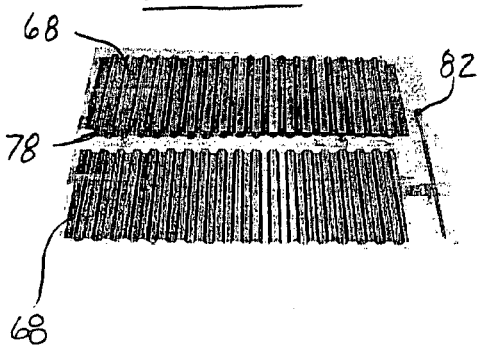
FIG. 14 is a perspective view adhesive applied to the formed material.

The material used in molding the double cell configuration of the present invention can be any suitable moldable material. In one embodiment of the invention, an advanced composite material may be used comprising an epoxy resin prepreg reinforced with unidirectional carbon fibers. Referring now to FIG. 10, a sheet 80 of prepreg material is placed over the bottom base 62 of the mold 60. The longitudinal top mold members 64 are individually positioned and pressed one at a time by securing the top mold member 64 to the bottom base 62. This allows the prepreg material 80 to properly form inside the mold cell groove or cavity. Once all the top mold members 64 are properly positioned and secured to the bottom base 62, the mold 60 is placed in an oven 55 (see FIG. 11) and cured based on a suitable prepreg temperature curing cycle such as that shown in FIG. 12. After the part is cured, the part is demolded by removing the top mold members 64 from the bottom base 62 as shown in FIG. 13. The process is the same for the inner and the outer cells 40, 30. An adhesive 82 is applied to the molded sheets 68, 78 of half cells to form a completed sheet of cells as shown in FIG. 14. In completing the double cell configuration of the present invention, the inner cells 30 are formed first by adhering two molded sheets 78 of the inner half cells. The outer cells 40 are then formed by adhering one molded sheet 68 of outer half shells to the top sheet 78 of inner cells 30 and adhering one molded sheet 68 of outer half shells to the bottom sheet 78 of the inner cells to form a sheet 88 of double hexagonal cells. Adhesive 82 may be applied to the outer portions 78 of sheet 88 to position and secure multiple sheets 88 in the nested manner to form a double wall honeycomb structure 10 as best shown in FIG. 15.

One particular adhesive that has been found to be effective is a two-part epoxy adhesive comprising a resin and a curing agent such as 815C Epon resin and 3140 EPI-Cure curing agent manufactured by Shell. It is also contemplated that the properties of the adhesive may be improved with one or more additives. An example of such is the addition of catalytic multi-wall carbon nanotubes which have been found to increase the modulus of the epoxy adhesive as well as decreasing the moisture absorption of the epoxy adhesive. Although an example of a particular adhesive has been discussed, the invention is not intended to be limited as such and any suitable adhesive or means for attaching the cells to one another is contemplated such as welding, thermal fusion bonding, etc.

The double wall honeycomb structure 10 can then be machined to its final dimensions (see FIG. 16) and subjected to any post processing which may be used to enhance the physical characteristics of the structure 10. For example, in applications where the structure 10 is subjected to water, it is contemplated the cells may be partially or completely filled with a water resistant material. The first and second cells 30, 40 may alternatively be coated with a water resistant substance. Particular attention may be paid to machined surfaces which, depending on the core material used, may need to be coated with a protective substance to inhibit water ingress, corrosion, or other factors which may inhibit the performance of a particular core material in a particular application.

Figure 17:
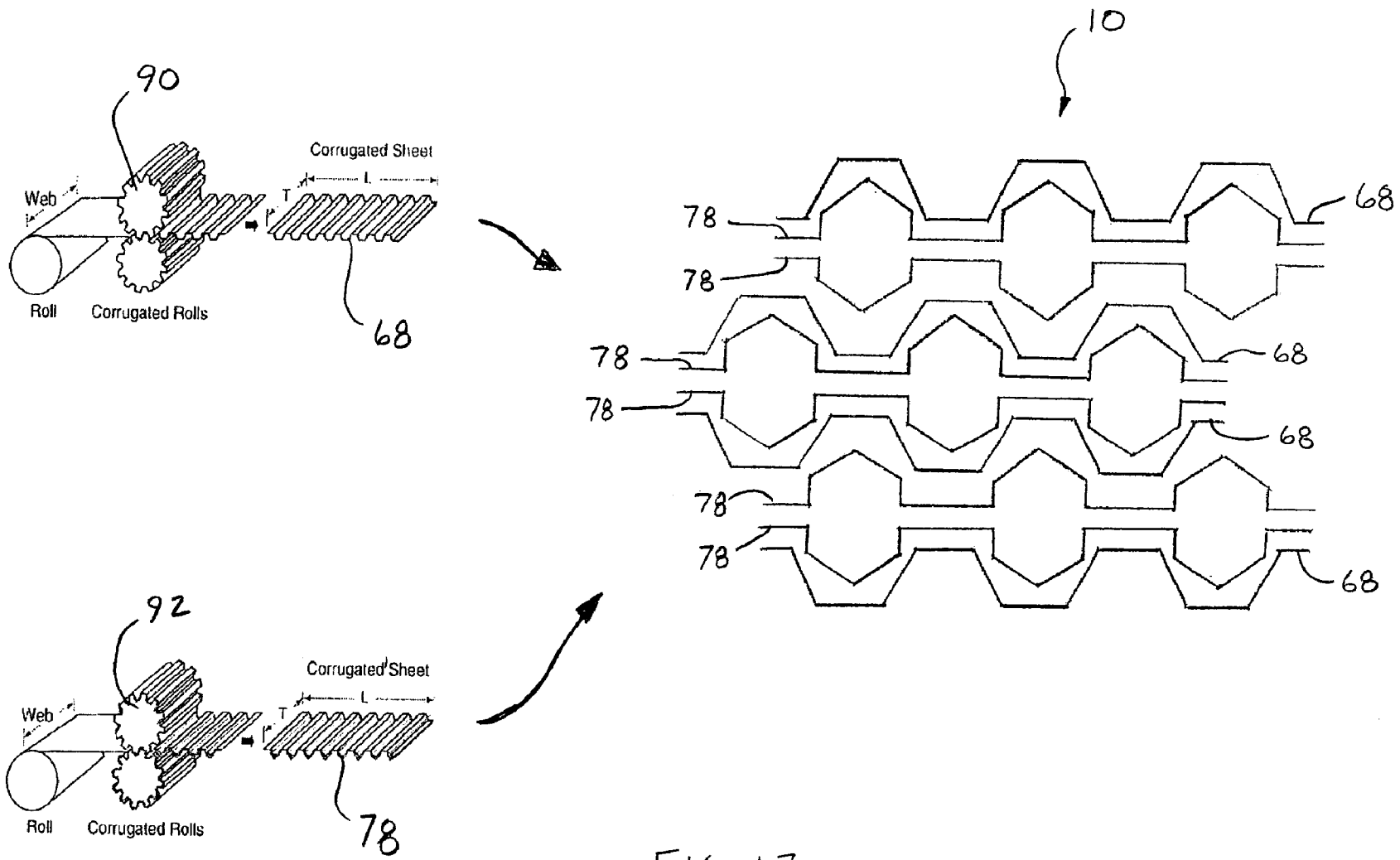
FIG. 17 is an alternate method of forming the corrugated sheets used in a method of the present invention.

Although the core material discussed above is an epoxy resin prepreg, the invention is not intended to be limited to a particular core material. It is contemplated that the double cell configuration of the present invention can be manufactured of the same materials currently being used in prior art structures such as metallic, polymeric, ceramic, and other non-metallic materials such as paper (NOMEX®) or corrugated cardboard. The repeated structure of the dual walled cells may be manufactured using forming techniques, corrugated forming processes, extruding, molding or any other appropriate manufacturing technique. A corrugated process utilizing a corrugated roller 90 is used to form honeycomb sheets 68 is shown in FIG. 17 which can be used with materials such as NOMEX® paper, aluminum, or other such formable materials. It is contemplated that a second set of corrugated rolls 92 having teeth similar to the profile of the inner mold 70 may be used to produce corrugated sheets 78 to produce the inner cells 40 of the double cell structure 10 of the present invention. Adhesive would then be applied to the sheets, and the sheets would then be stacked in the same manner as the molding method discussed above and shown in FIG. 17.

Another advantage of the present invention is that the second cell 40 provides additional locations or surface area for bonding to a cover material (not shown) on either end of the structure 10. The additional bonding helps prevent delamination of the cover material from the ends of the cells 30, 40. The second cell 40 also increases the shear strength and the compression strength of the structure 10 and also increases the impact resistance of the structure 10.

It is further contemplated that the first cell 30 may be manufactured of a first material having first material properties, while the second cell 40 may be manufactured of a second material having second material properties. This feature will allow the structure 10 to be engineered toward a particular application in which multiple materials may have favorable characteristics when used in combination which may not be present when using only one of the first and second materials.

New continuous/semi-continuous processes are currently being developed for producing honeycomb panels. Examples of these processes include rotational and continuous thermoplastic honeycomb panel production lines. It is contemplated that these processes may be adapted to create the double walled honeycomb structure of the present invention.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A method of manufacturing a structure comprising the steps of:

forming a plurality of sheets of material into a first corrugated configuration;

forming a plurality of sheets of material into a second corrugated configuration different from the first corrugated configuration;

attaching two of the plurality of sheets of the first corrugated configuration to form a series of first cells;

attaching one of the plurality of sheets of the second corrugated configuration to each side of the attached two of the plurality of sheets of the first corrugated configuration to form a series of polygonal cells, each polygonal cell surrounding a corresponding first cell such that each first cell only contacts an interior of the corresponding polygonal cell at a midpoint of each wall of the polygonal cell such that the first cell reinforces the polygonal cell providing additional strength to the structure.

2. The method of claim 1, wherein the polygonal cells are hexagons.

3. The method of claim 1, wherein the steps of forming the sheets into the first and second corrugated configuration is accomplished using a first and second mold.

4. The method of claim 1, wherein the steps of forming the sheets into the first and second corrugated configuration is accomplished using a first and second set of corrugated rolls.

5. The method of claim 1, wherein the steps of attaching the formed sheets of material to each other is accomplished using an adhesive.

6. The method of claim 1, wherein the steps of attaching the formed sheets of material to each other is accomplished by welding or thermal fusion.

7. The method of claim 1, wherein the steps of forming the sheets each comprise the steps of inserting the sheets into a mold, placing the mold in an oven, curing the sheets, removing the mold from the oven, and removing the formed sheets from the mold.

8. The method of claim 1, wherein the step steps of forming the sheets each comprise the step of providing a plurality of epoxy resin prepreg sheets.

9. The method of claim 1, further comprising the step of machining the structure to its final form.

10. The method of claim 1 wherein the first cells are formed as circles.

11. The method of claim 1 wherein the first cells are formed as polygons.

12. The method of claim 1 wherein the first cells are formed as ellipses.

13. A method of manufacturing a structure comprising the steps of:

providing a plurality of sheets of material each having a first side and a second side;

forming a first sheet into a series of four repeating surfaces each surface formed generally 120 degrees from each adjacent surface, wherein the first surface and the third surface are generally parallel to each other and the second and fourth surfaces are formed at an included angle of approximately 60 degrees;

forming a second sheet into a series of four repeating surfaces each surface formed generally 120 degrees from each adjacent surface, wherein the first surface and the third surface are generally parallel to each other and the second and fourth surfaces are formed at an included angle of approximately 60 degrees;

forming a third sheet into a corrugated configuration different from the first and second sheets;

forming a fourth sheet into a corrugated configuration generally the same as the third sheet;

attaching the third sheet and the fourth sheet to form a series of first cells, wherein the attachment of the third sheet to the fourth sheet occurs after forming steps of the third sheet and fourth sheet;

attaching the first sheet to the third sheet and attaching the second sheet to the fourth sheet such that the second, third, and fourth surfaces of the first and second sheets form a series of polygonal cells separated from adjacent polygonal cells by the first surfaces of each of the first and second sheets, each polygonal cell surrounding a corresponding first cell such that each first cell only contacts an interior of the corresponding polygonal cell at a midpoint of each wall of the polygonal cell such that the first cell reinforces the polygonal cell providing additional strength to the structure.

14. The method of claim 13, wherein the steps of forming the first, second, third, and fourth sheets is accomplished using corrugated rollers.

15. The method of claim 13, wherein the steps of attaching the third sheet to the fourth sheet, attaching the first sheet to the third sheet, and attaching the second sheet to the fourth sheet are accomplished by using an adhesive.

16. The method of claim 13, wherein the steps of attaching the third sheet to the fourth sheet, attaching the first sheet to the third sheet, and attaching the second sheet to the fourth sheet are accomplished by welding.

17. The method of claim 13 wherein the first cells are formed as circles.

18. The method of claim 13 wherein the first cells are formed as polygons.

19. The method of claim 13 wherein the first cells are formed as ellipses.

20. The method of claim 13, wherein the steps of forming the first, second, third, and fourth sheets is accomplished in a molding process.

21. The method of claim 20, wherein the molding process comprises the following steps:

providing a mold wherein the mold is used to form the first and second sheets, the mold having a mold base and at least one top mold member;

placing one of the plurality of sheets on the mold base;

sequentially positioning, pressing, and securing each of the at least one top mold members to the mold base;

placing the mold into an oven and curing the sheet;

removing the mold from the oven and allowing the sheet to cool; and removing the formed sheet from the mold.

* * * * *